US011341946B2

(12) United States Patent
Lao

(10) Patent No.: US 11,341,946 B2
(45) Date of Patent: May 24, 2022

(54) METHOD FOR DETERMINING A KARAOKE SINGING SCORE, TERMINAL AND COMPUTER-READABLE STORAGE MEDIUM

(71) Applicant: GUANGZHOU KUGOU COMPUTER TECHNOLOGY CO., LTD., Guangzhou (CN)

(72) Inventor: Zhenfeng Lao, Guangzhou (CN)

(73) Assignee: GUANGZHOU KUGOU COMPUTER TECHNOLOGY CO., LTD., Guangzhou (CN)

( * ) Notice: Subject to any disclaimer, the term of this patent is extended or adjusted under 35 U.S.C. 154(b) by 230 days.

(21) Appl. No.: 16/621,628

(22) PCT Filed: Nov. 27, 2018

(86) PCT No.: PCT/CN2018/117768
§ 371 (c)(1),
(2) Date: Dec. 11, 2019

(87) PCT Pub. No.: WO2019/105351
PCT Pub. Date: Jun. 6, 2019

(65) Prior Publication Data

US 2020/0168198 A1 May 28, 2020

(30) Foreign Application Priority Data

Nov. 30, 2017 (CN) ..... 201711239668.1

(51) Int. Cl.
*G10H 1/36* (2006.01)

(52) U.S. Cl.
CPC ..... *G10H 1/361* (2013.01); *G10H 2210/005* (2013.01); *G10H 2210/066* (2013.01); *G10H 2210/091* (2013.01)

(58) Field of Classification Search
CPC ..... G10H 1/361; G10H 2210/005; G10H 2210/066; G10H 2210/091
(Continued)

(56) References Cited

U.S. PATENT DOCUMENTS 8,634,759 B2 * 1/2014 Bates ..... A63F 13/814 434/307 A
8,868,411 B2 * 10/2014 Cook ..... G10L 13/0335 704/207
(Continued)

FOREIGN PATENT DOCUMENTS

CN 101859560 A 10/2010
CN 104978982 A 10/2015
(Continued)

OTHER PUBLICATIONS

Written Opinion and International Search Report in PCT application No. PCT/CN2018/117768 dated Feb. 11, 2019.
(Continued)

*Primary Examiner* — Christina M Schreiber
(74) *Attorney, Agent, or Firm* — Knobbe Martens Olson & Bear LLP

(57) ABSTRACT

The present disclosure relates to a method and an apparatus for determining a karaoke singing score, and belongs to the technical field of karaoke singing systems. The method includes: capturing a singing audio by an audio capture device upon detection of a karaoke singing instruction to a target song; acquiring a plurality of time units obtained by dividing a preset voice period of the target song; for each time unit, performing time offset adjustment on the time unit based on a preset adjustment duration to obtain at least one offset time unit, determining pitch values corresponding to the time unit and each time offset unit respectively in the captured singing audio, scoring each of the determined pitch values based on a preset reference pitch value of the time
(Continued)

unit, and determining the highest score as a score corresponding to the time unit; and determining a total score of the singing audio based on the score corresponding to each time unit. The method and the apparatus have the advantage that scoring accuracy of the singing audio is improved.

17 Claims, 5 Drawing Sheets

(58) Field of Classification Search
USPC ..... 84/610
See application file for complete search history.

(56) References Cited

U.S. PATENT DOCUMENTS

| | | | | |
|---|---|---|---|---|
| 2007/0178971 | A1* | 8/2007 | Bates | A63F 13/10 463/43 |
| 2020/0168198 | A1* | 5/2020 | Lao | G10H 1/361 |
| 2021/0274301 | A1* | 9/2021 | Peng | H04R 3/04 |

FOREIGN PATENT DOCUMENTS

| | | | |
|---|---|---|---|
| CN | 105788581 | A | 7/2016 |
| CN | 106057213 | A | 10/2016 |
| CN | 106157977 | A | 11/2016 |
| CN | 106782600 | A | 5/2017 |
| CN | 108008930 | A | 5/2018 |
| JP | 2005-107332 | A | 4/2005 |
| JP | 2008-40259 | A | 2/2008 |
| JP | 2016-50974 | A | 4/2016 |

OTHER PUBLICATIONS

First office action in Chinese application No. 201711239668.1 dated May 31, 2019.
Notification to Grant Patent Right for Invention of Chinese Application No. 201711239668.1—6 pages (May 22, 2020).
Extended European Search Report of counterpart EP application No. 18882740.6—13 pages (Jul. 15, 2020).
Mcnab et al, "Signal Processing for Melody Transcription", Computer Science Conference, 2000. ACSC 2000. 23rd Australasian Canberra, ACT, Australia Jan. 31-Feb. 3, 2000, Los Alamitos, CA, USA, IEEE Comput. Soc, US, vol. 18, No. 1, paragraphs [03. 2], [0004], [05.1]; figure 1-7 pages (Jan. 31, 1996).

* cited by examiner

METHOD FOR DETERMINING A KARAOKE SINGING SCORE, TERMINAL AND COMPUTER-READABLE STORAGE MEDIUM

This application is a national phase of PCT patent application No.: PCT/CN2018/117768 filed on Nov. 27, 2018, which claims priority to Chinese Patent Application No. 201711239668.1, filed on Nov. 30, 2017 and entitled "METHOD AND APPARATUS FOR DETERMINING A KARAOKE SINGING SCORE", the entire contents of which are incorporated herein by reference.

TECHNICAL FIELD

The present disclosure relates to the technical field of karaoke systems, and more particularly, relates to a method for determining a karaoke singing score, a terminal and a computer-readable storage medium.

BACKGROUND

More and more users prefer to use a karaoke application in a mobile phone to sing karaoke. After singing, the karaoke application may score the singing of a user, providing a reference to indicate how close the user's singing voice is to the original sing, which brings brings functionality and entertainment.

SUMMARY

According to a first aspect of embodiments of the present disclosure, a method for determining a karaoke singing score is provided. The method includes:

acquiring a singing audio by an audio capture device upon detection of a karaoke singing instruction about a target song;

for each time unit, determining pitch values corresponding to the time unit and each time offset unit respectively in the singing audio, scoring each of the pitch values corresponding to the time unit and each time offset unit based on a reference pitch value of the time unit, to obtain a score corresponding to the time unit; wherein the time unit is obtained by dividing a voice period of the target song, and the time offset unit is obtained by performing time offset adjustment on a corresponding time unit based on an adjustment duration; and determining a total score of the singing audio based on a score corresponding to each time unit.

Optionally, each time unit and each offset time unit respectively contain a plurality of unit durations;

determining pitch values corresponding to the time unit and each time offset unit respectively in the singing audio, scoring each of the pitch values corresponding to the time unit and each time offset unit based on a reference pitch value of the time unit, to obtain a score corresponding to the time unit includes:

in the singing audio, determining a pitch value corresponding to each unit duration contained in the time unit and a pitch value corresponding to each unit duration contained in each offset time unit;

determining a unit duration score corresponding to each unit duration contained in the time unit according to the pitch value corresponding to each unit duration contained in the time unit and the reference pitch value of the time unit;

determining a unit duration score corresponding to each unit duration contained in each offset time unit according to the pitch value corresponding to each unit duration contained in each offset time unit and the reference pitch value of the time unit;

determining a reference score corresponding to the time unit according to the unit duration score corresponding to each unit duration contained in the time unit;

determining a reference score corresponding to each offset time unit according to the unit duration score corresponding to each unit duration contained in each offset time unit; and determining a score corresponding to the time unit based on the reference score corresponding to the time unit and the reference score corresponding to each offset time unit.

Optionally, determining a unit duration score corresponding to each unit duration contained in the time unit according to the pitch value corresponding to each unit duration contained in the time unit and the reference pitch value of the time unit includes:

determining a difference between the pitch value corresponding to each unit duration contained in the time unit and the reference pitch value of the time unit, to obtain a difference corresponding to each unit duration contained in the time unit, and determining, based on a corresponding relationship between difference ranges and unit duration scores, the unit duration score corresponding to each unit duration contained in the time unit respectively according to a difference range to which the difference corresponding to each unit duration contained in the time unit belongs; and determining a unit duration score corresponding to each unit duration contained in each offset time unit according to the pitch value corresponding to each unit duration contained in each offset time unit and the reference pitch value of the time unit includes:

determining a difference between the pitch value corresponding to each unit duration contained in each offset time unit and the reference pitch value of the time unit, to obtain a difference corresponding to each unit duration contained in each offset time unit, and determining, based on a corresponding relationship between difference ranges and unit duration scores, the unit duration score corresponding to each unit duration contained in each offset time unit respectively according to a difference range to which the difference corresponding to each unit duration contained in each offset time unit belongs.

Optionally, upon scoring each of the pitch values corresponding to the time unit and each time offset unit based on a reference pitch value of the time unit, to obtain a score corresponding to the time unit, the method further includes:

determining an adjustment duration of each offset time unit with the highest score relative to the corresponding time unit as an adjustment duration corresponding to each time unit;

determining a value obtained by dividing a sum of the adjustment durations corresponding to each of time units by a number of the time units as an average of the adjustment durations; and determining a total score of the singing audio based on a score corresponding to each time unit includes:

determining the total score of the singing audio based on the score corresponding to each time unit if an absolute value of a difference between the adjustment duration corresponding to each time unit and the average of the adjustment durations is less than a difference threshold.

Optionally, determining a reference score corresponding to the time unit according to the unit duration score corresponding to each unit duration contained in the time unit includes:

determining, based on a weight corresponding to each unit duration score, a weighted average of unit duration scores corresponding to each of unit durations contained in the time unit as the reference score corresponding to the time unit; and determining a reference score corresponding to each offset time unit according to the unit duration score corresponding to each unit duration contained in each offset time unit includes:

determining, based on a weight corresponding to each unit duration score, a weighted average of unit duration scores corresponding to each of unit durations contained in each offset time unit as the reference score corresponding to the time unit.

Optionally, scoring each of the pitch values corresponding to the time unit and each time offset unit based on a reference pitch value of the time unit, to obtain a score corresponding to the time unit includes:

scoring each of the pitch values corresponding to the time unit and each time offset unit based on the reference pitch value of the time unit, and determining a highest score as the score corresponding to the time unit.

Optionally, each time unit corresponds to one note in the voice period; and a start moment of the time unit is a start moment of the corresponding note, and an end moment of the time unit is an end moment of the corresponding note.

Optionally, each time unit corresponds to a plurality of offset time units, the adjustment duration of each offset time unit relative to a corresponding time unit is a positive integer multiple of a unit adjustment time.

According to a second aspect of embodiments of the present disclosure, a terminal is provided. The terminal includes: a processor and a memory, wherein the memory stores at least one instruction, at least one program, a code set or an instruction set. The at least one instruction, the at least one program, the code set or the instruction set is loaded and executed by the processor to implement the method for determining the karaoke singing score as described above.

According to a third aspect of embodiments of the present disclosure, a computer-readable storage medium is provided. The storage medium stores at least one instruction, at least one program, a code set, or an instruction set. The at least one instruction, the at least one program, the code set or the instruction set is loaded and executed by a processor to implement the method for determining the karaoke singing score as described above.

In the method according to the embodiment of the present disclosure, when the karaoke singing instruction about the target song is detected, the singing audio is acquired by the audio capture device; the plurality of time units obtained by dividing the voice period of the target song is acquired; for each time unit, the time offset adjustment is performed on the time unit based on the preset adjustment duration to obtain at least one offset time unit, the pitch values corresponding to the time unit and each time offset unit are determined respectively in the captured singing audio, each of the determined pitch values is scored based on the reference pitch value of the time unit, and the score corresponding to the time unit is obtained; and the total score of the singing audio is determined based on the score corresponding to each time unit. In this way, if the capture and processing of the singing audio are delayed, in the above processing, the singing audio in one of the at least one offset time unit corresponding to the time unit may be the singing audio sung by the user in the time unit. It is apparent that the score of the time unit is not affected by the delay as the above highest score is selected as the score of the time unit, thereby improving scoring accuracy of the singing audio.

It is to be understood that both the above general description and the following detailed description are exemplary and illustrative only, and are not intended to limit the present disclosure.

DETAILED DESCRIPTION

Figure 1:
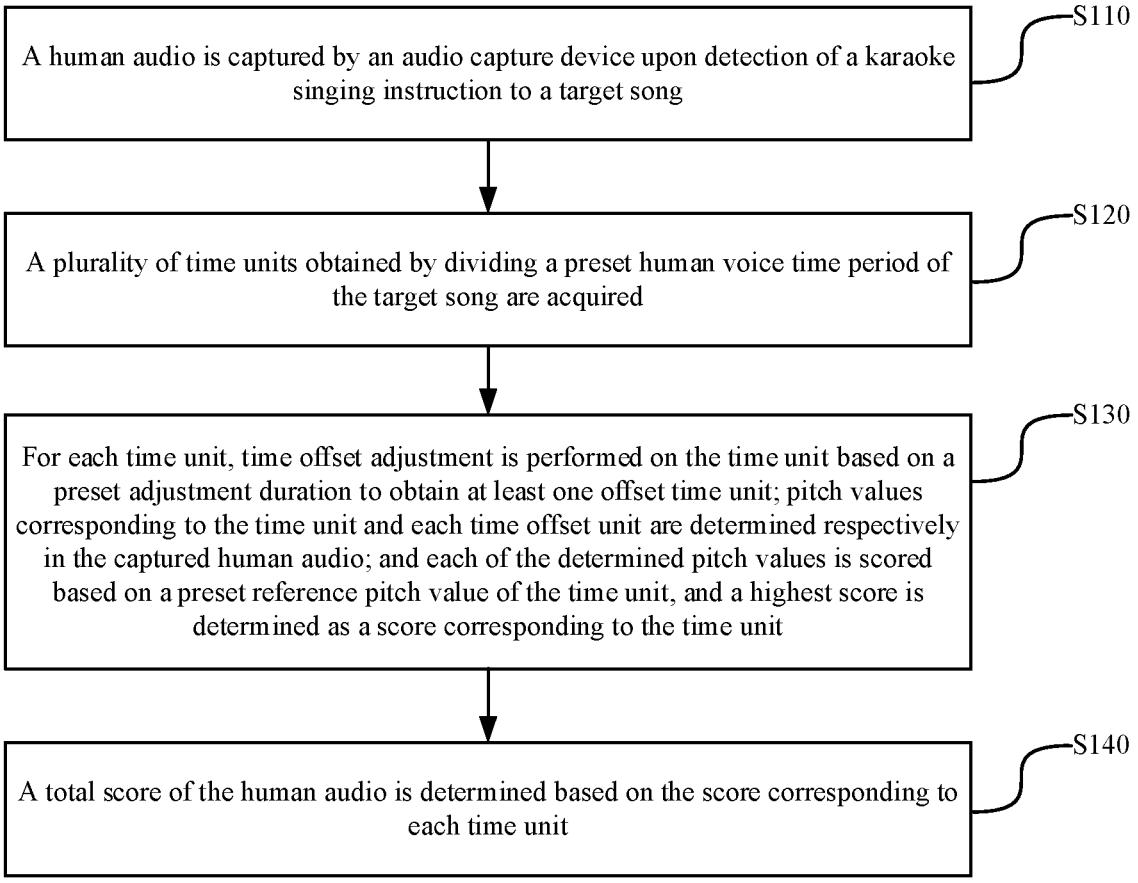
FIG. 1 is a flowchart of a method for determining a karaoke singing score according to an exemplary embodiment.

Reference is now be made in detail to exemplary embodiments, examples of which are illustrated in the accompanying drawings. Where the following description refers to the accompanying drawings, the same numbers in different drawings represent the same or similar elements unless otherwise represented. The implementations set forth in the following description of the exemplary embodiments do not represent all implementations consistent with the present disclosure. Instead, the implementations are merely examples of devices and methods consistent with aspects related to the disclosure as recited in the appended claims.

In related arts, the karaoke application may score the singing of a user. Specifically, the karaoke application acquires a captured singing audio at the beginning of audio recording, extracts a pitch corresponding to a current singing audio according to a preset frequency, compares the extracted pitch corresponding to the current singing audio with a standard pitch of a target song at a current time, and obtains a corresponding score if an absolute value of a difference between the extracted pitch corresponding to the current singing audio and the current standard pitch of the target song is less than a preset threshold. Similarly, all scores of the singing during the whole singing course of the target song are obtained. A final score is obtained after all the scores are added.

However, the related art at least has the following problems. A delay exists in a process that the user sings the song after hearing the accompaniment, and the mobile phone converts an analog signal of the singing audio into a digital signal executable by a processor of the mobile phone after capturing the analog signal of the singing audio. Thus, it is possible that the pitch corresponding to the singing audio extracted by the processor is not the pitch corresponding to the captured singing audio at the current time. If the pitch of the singing audio that does not correspond to the current time is compared with the current standard pitch, the determined score is not accurate.

Embodiments of the present disclosure provide a method for determining a karaoke singing score. The method may be implemented by a terminal. The terminal may be a mobile phone, a tablet computer, a desktop computer, a notebook computer, a karaoke machine, or the like.

The terminal may include components such as a processor and a memory. The processor may be a central processing unit (CPU) or the like. The memory may be a random access memory (RAM), a flash or the like, and may be configured to store received data, data required in processing, data generated in the processing, and the like. The data may be, such as, the preset reference pitch values of the time units.

The terminal may further include a transceiver, an input component, a display component, an audio output component, and the like. The transceiver may be configured to transmit data with a server, for example, acquire an updated music library from the server. The transceiver may include a Bluetooth component, a wireless fidelity (WiFi) component, an antenna, a matching circuit, a modem, and the like. The input component may be a touch screen, a keypad or keyboard, a mouse, or the like. The audio output component may be a speaker, an earphone, or the like.

A system program and an application may be installed in the terminal. A user may use a variety of applications based on his/her actual needs during use of the terminal. An application with a karaoke singing function may be installed in the terminal.

An exemplary embodiment of the present disclosure provides a method for determining a karaoke singing score. As shown in FIG. 1, a processing flow of the method may include the following steps.

In step S110, a singing audio is acquired by an audio capture device upon detection of a karaoke singing instruction about a target song.

Figure 2:
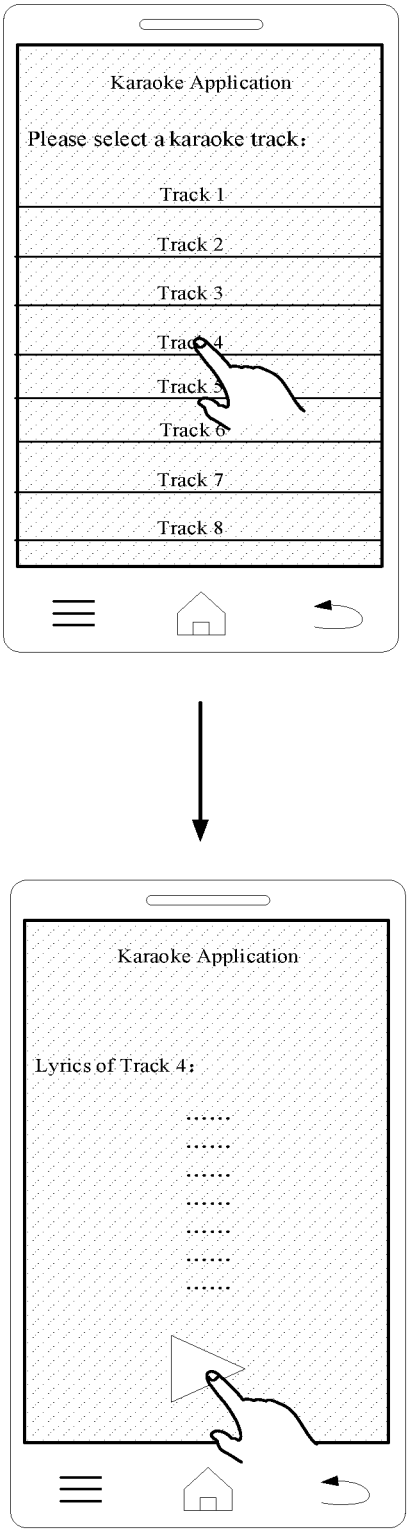
FIG. 2 is a schematic diagram illustrating a karaoke application interface according to an exemplary embodiment.

In practice, as shown in FIG. 2, when a user opens a karaoke application, a main interface of the karaoke application may display tracks that may be sung, such as tracks 1 to 8. When the user selects and clicks "track 4", a karaoke singing interface corresponding to the track 4 is displayed, wherein the track 4 is the target song described in the method according to the embodiment. After entering the karaoke singing interface corresponding to the track 4, the user may see lyrics of the track 4 and a triangular play button shown in FIG. 2. When the user clicks the triangular play button, the terminal may detect the karaoke singing instruction about the target song. Upon detecting the karaoke singing instruction to the target song, the terminal may capture the singing audio by the audio capture device, and the terminal may acquire the singing audio from the network or connected devices. For example, a microphone in the terminal may be turned on to capture the singing audio in the environment; or, acquired singing audio may be obtained from an audio capture device independent of the terminal through a wired or wireless connection.

In step S120, a plurality of time units obtained by dividing a voice period of the target song are acquired.

In practice, a standard library may be pre-established in the terminal, and standard information of each song is stored in the standard library. The standard information may include a start moment and an end moment (a preset voice period) of each note of the song, and a pitch value of each note. The end time may also be replaced by a lasting time duration. The singing audio captured by the audio capture device may be stored in the memory. Then, based on the standard information corresponding to the target song in the standard library, the captured singing audio is divided to obtain the plurality of time units. For example, 563517615, a numbered musical notation of the lyrics "I love you, China" is pre-stored in the standard library. Each number in the numbered musical notation represents one note. The start moment and the end moment of each note in the target song are as follows:

5-from 1 min 02 s 48 ms to 1 min 02 s 50 ms;
6-from 1 min 02 s 51 ms to 1 min 02 s 59 ms;
3-from 1 min 03 s 00 ms to 1 min 03 s 01 ms;
5-from 1 min 03 s 02 ms to 1 min 03 s 04 ms;
1-from 1 min 03 s 05 ms to 1 min 03 s 09 ms;
7-from 1 min 03 s 10 ms to 1 min 03 s 13 ms;
6-from 1 min 03 s 14 ms to 1 min 03 s 18 ms;
1-from 1 min 03 s 19 ms to 1 min 03 s 23 ms; and
5-from 1 min 03 s 24 ms to 1 min 03 s 49 ms.

The captured singing audio is divided corresponding to the start moment and the end moment of each note in the target song. In fact, for the singing audio, the time is recorded as 0:00 00 at the beginning of the accompaniment. Thus, after 0:00 00, the time corresponding to each note sung by the user in the singing audio may be determined. Ultimately, the lyrics "I love you, China" in the singing audio is divided into 9 time units. Therefore, optionally, each time unit corresponds to one note in the voice period; and the start moment and the end moment of the time unit are respectively the start moment and the end moment of the corresponding note. The duration of each time unit is determined according to the lasting time of the corresponding note, so that durations of the all time units are not necessarily the same.

In step S130, for each time unit, time offset adjustment is performed on the time unit based on a adjustment duration to obtain at least one offset time unit; pitch values corresponding to the time unit and each time offset unit are determined respectively in the singing audio; and each of the determined pitch values is scored based on a reference pitch value of the time unit, and a highest score is determined as a score corresponding to the time unit.

In practice, there is a delay in a process that the user sings the song after hearing the accompaniment, and the terminal converts an analog signal of the singing audio into a digital signal executable by a processor of the terminal after capturing the analog signal of the singing audio. Thus, the plurality of time units obtained by dividing the voice period of the target song is time units after the delay is generated. For example, the time of the note "5" recorded in the standard library is from 1 min 03 s 02 ms to 1 min 03 s 04 ms, while the generation time of the actual note "5" in the singing audio stored in the memory is from 1 min 03 s 12 ms to 1 min 03 s 14 ms. Therefore, it is necessary to adjust the division mode to divide the correct time unit corresponding to the note after the generation of the delay as much as possible. The specific process may include: performing time offset adjustment on the time unit based on the preset adjustment duration to obtain at least one offset time unit.

Figure 3:
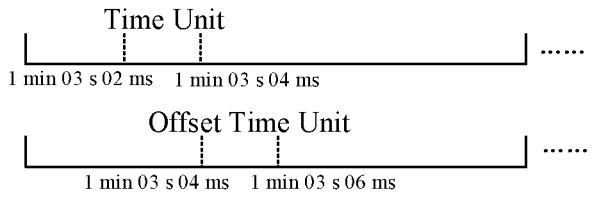
FIG. 3 is a schematic diagram of acquiring an offset time unit according to an exemplary embodiment.

In practice, for example, the time of the note "5" recorded in the standard library is from 1 min 03 s 02 ms to 1 min 03 s 04 ms; and accordingly, a preset time extension value may be added to each of the "1 min 03 s 02 ms" and "1 min 03 s 04 ms". As shown in FIG. 3, after adding 2 ms to each of the "1 min 03 s 02 ms"and" 1 min 03 s 04 ms", "1 min 03 s 04 ms"and" 1 min 03 s 06 ms" are obtained accordingly.

Optionally, the step of performing the time offset adjustment on the time unit based on the preset adjustment duration to obtain the at least one offset time unit may include: performing a preset number of times of the time offset adjustment on the time unit based on the preset adjustment duration, wherein one offset time unit is obtained after each time of the time offset adjustment.

Figure 4:
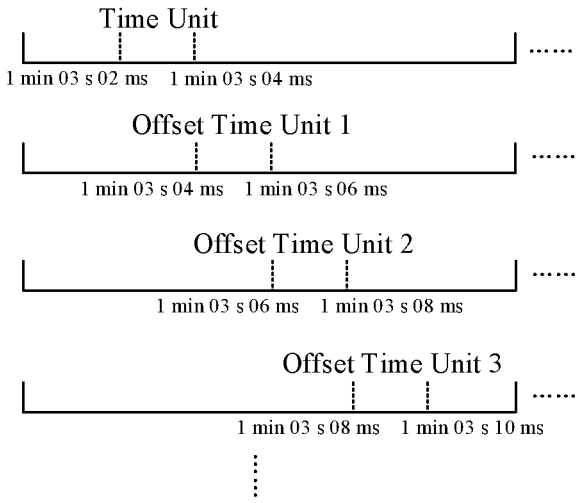
FIG. 4 is another schematic diagram of acquiring an offset time unit according to an exemplary embodiment.

In practice, the step of performing the preset number of times of time offset adjustment on the time unit based on a preset adjustment duration may be performed. In this way, corresponding to one time unit, a plurality of offset time units may be obtained after the time offset adjustment. It should be noted that the preset adjustment duration may be a positive number or a negative number. If the preset adjustment duration is the negative number, it indicates that the offset time unit ahead of the time unit is selected. As shown in FIG. 4, adding 2 ms to each of the "1 min 03 s 04 ms" and "1 min 03 s 06 ms", "1 min 03 s 06 ms" and "1 min 03 s 08 ms" are obtained accordingly. Adding 2 ms to each of the "1 min 03 s 06 ms" and "1 min 03 s 08 ms", "1 min 03 s 08 ms" and "1 min 03 s 10 ms" are obtained accordingly, etc.

In practice, at first, a fundamental frequency of the singing audio may be determined; and then, a pitch value corresponding to the fundamental frequency is determined according to the twelve-tone equal temperament. An autocorrelation function algorithm, the YIN algorithm and the PYIN algorithm may be adopted to determine the fundamental frequency of the singing audio. For a normal one-beat note, its lasting time may be 750 ms. A range of the pitch values of the singing audio is generally from 60 Hz to 1200 Hz. The pitch values of the singing audio may be extracted according to a preset cycle. For example, one pitch value of the singing audio is extracted every 20 ms. It is apparent that the plurality of pitch values of the singing audio may be extracted within the lasting time of one note. Optionally, the time unit and each offset time unit respectively contain a plurality of unit durations. The unit duration is the preset cycle that is adopted to extract the above pitch values of the singing audio.

Correspondingly, the step of determining the pitch values corresponding to the time unit and each offset time unit respectively in the captured singing audio, and scoring each of the determined pitch values based on the preset reference pitch value of the time unit may include three procedures hereinafter.

(1) In the captured singing audio, a pitch value corresponding to each unit duration contained in the time unit and a pitch value corresponding to each unit duration contained in each offset time unit are determined.

(2) According to the pitch value corresponding to each unit duration contained in the time unit and the preset reference pitch value of the time unit, a unit duration score corresponding to each unit duration contained in the time unit is determined; and according to the pitch value corresponding to each unit duration contained in each offset time unit and the preset reference pitch value of the time unit, a unit duration score corresponding to each unit duration contained in each offset time unit is determined.

(3) Based on the unit duration score corresponding to each unit duration contained in the time unit, a reference score corresponding to the time unit is determined; and based on the unit duration score corresponding to each unit duration contained in each offset time unit, a reference score corresponding to each offset time unit is determined.

It should be noted that the process of determining the score corresponding to each time unit and the process of determining the score corresponding to each offset time unit may not be limited in sequence. For example, the process of determining the score corresponding to each offset time unit may be after the process of determining the score corresponding to each time unit; or, the score corresponding to each time unit may be determined one by one, while the score corresponding to each offset time unit may be determined one by one; or, the process of determining scores corresponding to time units and the offset time units may be processed in parallel according to desired number of concurrent tasks.

In practice, for example, for a note, the pitch values corresponding to all unit durations contained in the time unit are 67, 68, 68, 67, and 68, respectively. The pitch values corresponding to all unit durations contained in the offset time unit are 68, 70, 71, 72, and 71, respectively. The preset reference pitch value of the time unit is 70. According to the above data, the unit duration score corresponding to each unit duration contained in each offset time unit may be determined.

Optionally, a manner for determining the unit duration score is provided. The step of determining a unit duration score corresponding to each unit duration contained in the time unit according to the pitch value corresponding to each unit duration contained in the time unit and the preset reference pitch value of the time unit may include: determining a difference between the pitch value corresponding to each unit duration contained in the time unit and the preset reference pitch value of the time unit to obtain a difference corresponding to each unit duration contained in the time unit; and determining a unit duration score corresponding to a difference range to which the difference corresponding to each unit duration contained in the time unit belongs according to a pre-stored corresponding relationship between difference ranges and unit duration scores. The step of determining a unit duration score corresponding to each unit duration contained in each offset time unit according to the pitch value corresponding to each unit duration contained in each offset time unit and the preset reference pitch value of the time unit may include: determining a difference between the pitch value corresponding to each unit duration contained in each offset time unit and the preset reference pitch value of the time unit to obtain the difference corresponding to each unit duration contained in each offset time unit; and determining a unit duration score corresponding to a difference range to which the difference corresponding to each unit duration contained in each offset time unit belongs according to a pre-stored corresponding relationship between difference ranges and unit duration scores.

In practice, following the above example, the differences corresponding to the all unit durations contained in the time unit are −3, −2, −2, −3, and −2, respectively. The differences corresponding to the all unit durations contained in the offset time unit are −2, 0, 1, 2, and 1, respectively. If the difference is 0, the score is a; if an absolute value of the difference is within 1 (including 1), the score is b; if the absolute value of the difference is within 2 (including 2) but outside 1 (excluding 1), the score is c; and if the absolute value of the difference is outside 2 (excluding 2), the score is 0, wherein a>b>c. In this way, the unit duration score corresponding to the difference range to which the difference corresponding to each unit duration contained in the time unit belongs may be determined, and the unit duration score corresponding to a difference range to which the difference corresponding to each unit duration contained in each offset time unit belongs may be determined.

In practice, based on the unit duration score corresponding to each unit duration contained in the time unit, the reference score corresponding to the time unit may be determined. Based on the unit duration score corresponding to each unit duration contained in each offset time unit, the score corresponding to each offset time unit may be determined. The reference score corresponding to the time unit or the reference score corresponding to each offset time unit may be calculated by the following equation:

$$y = d * \sum_{k=1}^{p} a_k + e * \sum_{k=1}^{q} b_k + f * \sum_{k=1}^{t} c_k. \quad (1)$$

In this equation, y is a reference score corresponding to the time unit or a score corresponding to each offset time unit; d, e, and f are weights corresponding to a, b, and c, respectively, and values of the weights are between 0 and 1, and may be adjusted according to requirements; a, b, and c are scores; and p, q, and t are the number of a, the number of b, and the number of c, respectively.

In practice, finally, the highest score may be determined as the score corresponding to the time unit. For example, if the reference score corresponding to the time unit is 20, the reference score corresponding to the offset time unit 1 is 25, the reference score corresponding to the offset time unit 2 is 27, the reference score corresponding to the offset time unit 3 is 37, the reference score corresponding to the offset time unit 4 is 40, and the reference score corresponding to the offset time unit 5 is 32, the reference score of 40 corresponding to the offset time unit 4 is determined as the score corresponding to the time unit. Alternatively, for example, an average value or weighted average value of all scores may be determined as the score corresponding to the time unit; or, an average value or weighted average value of selected scores (non-zero scores for example) may be determined as the score corresponding to the time unit.

Optionally, while the highest score is determined as the score corresponding to the time unit, an offset distance of the time unit or the offset time unit corresponding to the highest score may be determined. If the highest score corresponds to a time unit, the offset distance is 0. If the highest score corresponds to the offset time unit, for example the offset time unit 4, the offset distance of the offset time unit 4 with respect to the time unit may be determined. If the preset adjustment duration is 2, the offset distance of the offset time unit 1 with respect to the time unit is 2, the offset distance of the offset time unit 2 with respect to the time unit is 4, the offset distance of the offset time unit 3 with respect to the time unit is 6, and the offset distance of the offset time unit 4 with respect to the time unit is 8. Therefore, it may be determined that the offset distance of the offset time unit 4 with respect to the time unit is 8, that is, the offset distance of the time unit or the offset time unit corresponding to the highest score is 8. It should be noted that, if there are multiple equal highest scores, the offset distance with the smallest absolute value in the offset distances corresponding to the multiple equal highest scores is selected.

Optionally, after each of the determined pitch values is scored according to the preset reference pitch value of the time unit and the highest score is determined as the score corresponding to the time unit, the method according to the embodiment of the present disclosure may further include: determining an adjustment duration of each offset time unit with the highest score relative to the corresponding time unit to obtain an adjustment duration corresponding to each time unit; and determining a value obtained by dividing the sum of the adjustment durations corresponding to the all time units by the number of the time units to obtain an average of the adjustment durations. The step of determining a total score of the singing audio based on the score corresponding to each time unit may include: determining the total score of the singing audio based on the score corresponding to each time unit if an absolute value of a difference between the adjustment duration corresponding to each time unit and the average is less than a preset difference threshold.

After the offset distance of each note is determined, an average of the offset distances of the target song may be calculated, or an average of the offset distances of one lyric in the target song may be calculated. Specifically, the adjustment duration of each offset time unit with the highest score relative to the corresponding time unit may be determined, and is taken as the adjustment duration corresponding to each time unit. The value obtained by dividing the sum of the adjustment durations corresponding to the all time units by the number of the time units is determined to obtain the average of the adjustment durations. An absolute value of a difference between the offset distance of the time unit or the offset time unit corresponding to each highest score and the average is calculated. If each absolute value is less than a preset difference threshold, such as being the half of the preset adjustment duration, the total score of the singing audio may be determined based on the score corresponding to each time unit. In this way, if there is a systematic deviation between the standard pitch library and the accompaniment time, or the karaoke singing system has a delay, or other similar reasons exist, but the user sings according to the tempo of the accompaniment, a different may be exist between the pitch value of each lyric sung by the user and the standard pitch value. As a result, basically, all the finally obtained highest scores are generated in the offset time units earlier or later than the corresponding time unit(s). That is, an absolute value of a difference between the offset distance of the time unit or the offset time unit corresponding to each highest score and the average is less than a preset distance threshold.

In step S140, a total score of the singing audio is determined based on the score corresponding to each time unit.

In practice, after the score corresponding to each time unit, namely, each note in the singing audio is determined, all the scores are added to obtain a total score determined as the total score of the singing audio.

In the method according to the embodiment of the present disclosure, the singing audio is captured by the audio capture device upon detection of the karaoke singing instruction to the target song; the plurality of time units obtained by dividing the preset voice period of the target song is acquired; for each time unit, the time offset adjustment is performed on the time unit based on the preset adjustment duration to obtain at least one offset time unit, the pitch values corresponding to the time unit and each time offset unit are determined respectively in the captured singing audio, each of the determined pitch values is scored based on the preset reference pitch value of the time unit, and the highest score is determined as the score corresponding to the time unit; and the total score of the singing audio is determined based on the score corresponding to each time unit. In this way, if the capture and processing of the singing audio are delayed, in the above processing, the singing audio in one of the at least one offset time unit corresponding to the time unit may be the singing audio sung by the user in the time unit. It is apparent that the score of the time unit is unaffected by the delay as the above highest score is selected as the score of the time unit, thereby improving scoring accuracy of the singing audio.

It should be noted that the above-mentioned process of dividing a voice period of the target song and performing time offset adjustment on a corresponding time unit based on an adjustment duration may be completed in advance, or may be performed by a device other than the terminal. In an example, the terminal may divide a voice period of each target song to obtain the time units, perform time offset adjustment on each time unit to obtain at least one offset time unit, and then correlate the correlation between the time unit and the offset time unit. The data is stored in an appropriate form to be read and used when the score needs to be determined. In yet another example, the above process may be completed by a server in a song library, so that the terminal can implement the method provided by the embodiment of the present disclosure by requesting relevant data from the server when needed. It can be seen that the method according to the embodiment of the present disclosure may not include the above-mentioned process of dividing a voice period of the target song and/or performing time offset adjustment on a corresponding time unit based on an adjustment duration.

Figure 5:
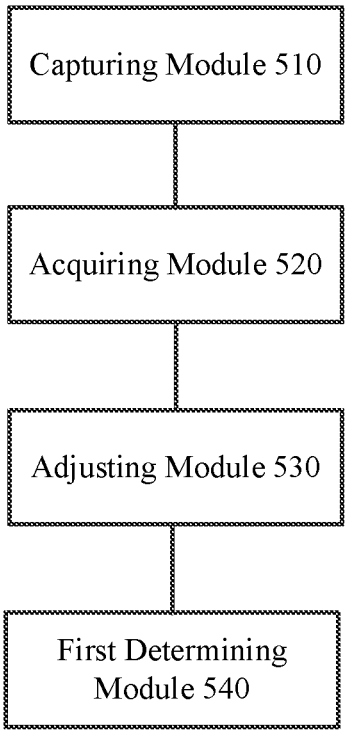
FIG. 5 is a schematic structural diagram of an apparatus for determining a karaoke singing score according to an exemplary embodiment.

Another exemplary embodiment of the present disclosure provides an apparatus for determining a karaoke singing score. As shown in FIG. 5, the apparatus includes:

a capturing module 510, configured to acquire a singing audio by an audio capture device upon detection of a karaoke singing instruction about a target song;

an acquiring module 520, configured to acquire a plurality of time units obtained by dividing a preset voice period of the target song;

an adjusting module 530, configured to, for each time unit, pitch values corresponding to the time unit and each time offset unit respectively in the singing audio, scoring each of the pitch values corresponding to the time unit and each time offset unit based on a reference pitch value of the time unit, to obtain a score corresponding to the time unit; wherein the time unit is obtained by dividing a voice period of the target song, and the time offset unit is obtained by performing time offset adjustment on a corresponding time unit based on an adjustment duration; and a first determining module 540, configured to determine a total score of the singing audio based on the score corresponding to each time unit.

Optionally, each time unit corresponds to one note in the voice period; and a start moment and an end moment of the time unit are respectively a start moment and an end moment of the corresponding note.

Optionally, the adjusting module 530 is configured to perform a preset number of times of the time offset adjustment on the time unit based on the preset adjustment duration, wherein one offset time unit is obtained after each time of the time offset adjustment.

Optionally, the time unit and each offset time unit respectively contain a plurality of unit durations.

Figure 6:
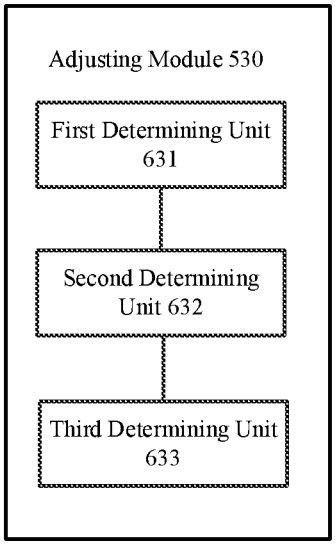
FIG. 6 is a schematic structural diagram of another apparatus for determining a karaoke singing score according to an exemplary embodiment.

As shown in FIG. 6, the adjusting module 530 includes:

a first determining unit 631, configured to, in the captured singing audio, determine a pitch value corresponding to each unit duration contained in the time unit and a pitch value corresponding to each unit duration contained in each offset time unit;

a second determining unit 632, configured to determine a unit duration score corresponding to each unit duration contained in the time unit according to the pitch value corresponding to each unit duration contained in the time unit and the preset reference pitch value of the time unit, and determine a unit duration score corresponding to each unit duration contained in each offset time unit according to the pitch value corresponding to each unit duration contained in each offset time unit and the preset reference pitch value of the time unit; and a third determining unit 633, configured to determine a reference score corresponding to the time unit based on the unit duration score corresponding to each unit duration contained in the time unit, and determine a reference score corresponding to each offset time unit based on the unit duration score corresponding to each unit duration contained in each offset time unit.

Optionally, the second determining unit 632 is configured to determine a difference between the pitch value corresponding to each unit duration contained in the time unit and the preset reference pitch value of the time unit to obtain a difference corresponding to each unit duration contained in the time unit, and determine a unit duration score corresponding to a difference range to which the difference corresponding to each unit duration contained in the time unit belongs according to a pre-stored corresponding relationship between difference ranges and unit duration scores.

Optionally, the second determining unit 632 is configured to determine a difference between the pitch value corresponding to each unit duration contained in each offset time unit and the preset reference pitch value of the time unit to obtain a difference corresponding to each unit duration contained in each offset time unit, and determine a unit duration score corresponding to a difference range to which the difference corresponding to each unit duration contained in each offset time unit belongs according to a pre-stored corresponding relationship between difference ranges and unit duration scores.

Optionally, the apparatus further includes:

a second determining module, configured to determine an adjustment duration of each offset time unit with the highest score relative to the corresponding time unit to obtain an adjustment duration corresponding to each time unit; and a third determining module is configured to determine a value obtained by dividing the sum of the adjustment durations corresponding to the all time units by the number of the time units to obtain an average of the adjustment durations.

The first determining module 540 is configured to determine the total score of the singing audio based on the score corresponding to each time unit if an absolute value of a difference between the adjustment duration corresponding to each time unit and the average is less than a preset difference threshold.

With respect to the apparatus in the above embodiments, the specific manners for individual modules in the apparatus to perform operations have been described in detail in the embodiments of the related methods, and will not be elaborated herein.

In this way, if the capture and processing of the singing audio are delayed, in the above processing, the singing audio in one of the at least one offset time unit corresponding to the time unit may be the singing audio sung by the user in the time unit. It is apparent that the score of the time unit is unaffected by the delay as the above highest score is selected as the score of the time unit, thereby improving scoring accuracy of the singing audio.

It should be noted that, during determining a karaoke singing score, the apparatus for determining the karaoke singing score is only illustrated by taking division of each functional module as an example. While in a practical application, the above functions may be assigned to different modules to be achieved according to needs. That is, an internal structure of the terminal may be divided into the different functional modules, so as to achieve all or part of the functions described above. In addition, the apparatus for determining the karaoke singing score and the method for determining the karaoke singing score provided by the above embodiments belong to the same concept. Specific implementation processes of the apparatus may refer to the embodiments of the method, and details thereof are not repeated herein.

Figure 7:
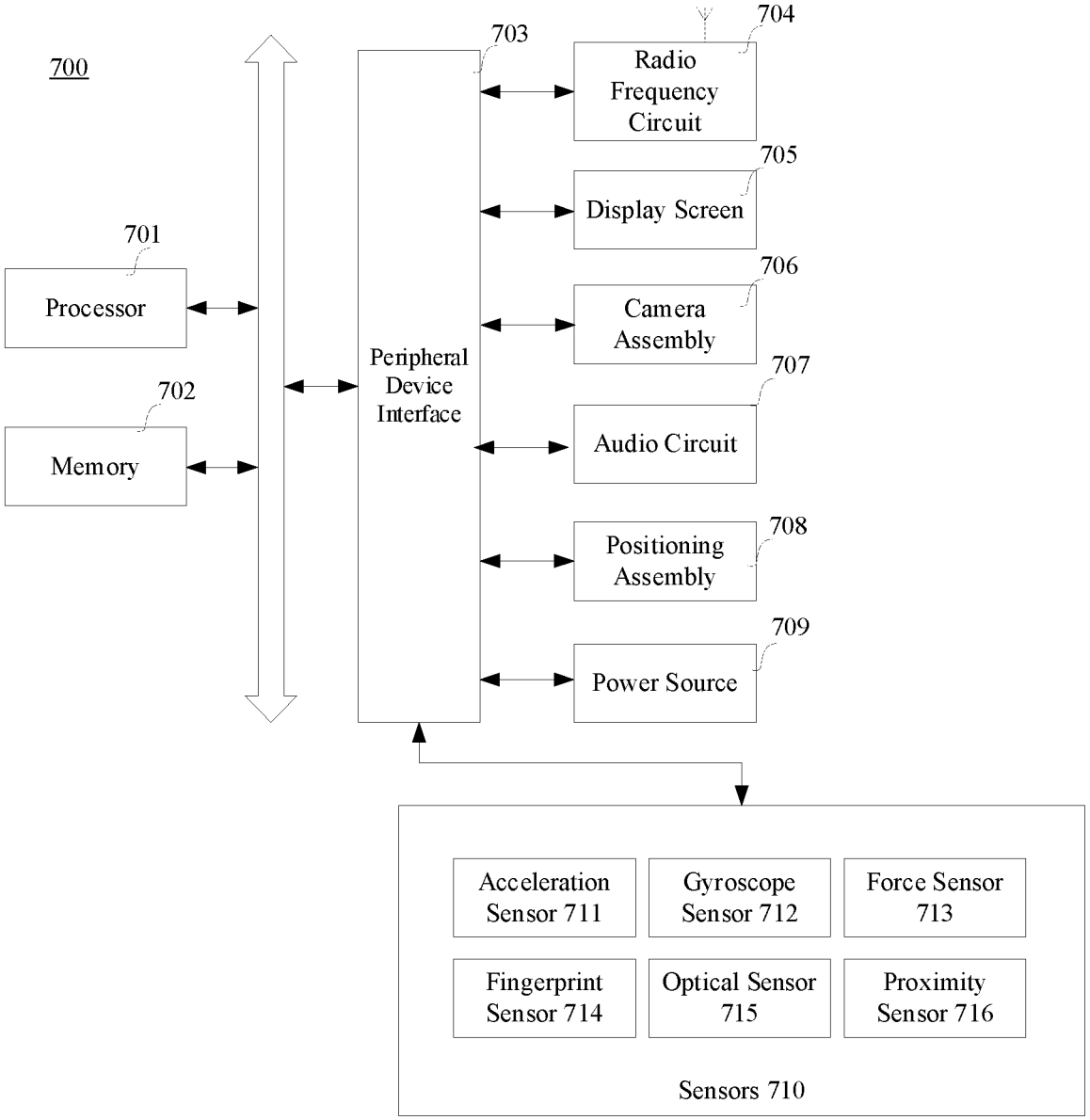
FIG. 7 is a schematic structural diagram of a terminal according to an exemplary embodiment.

FIG. 7 is a structural block diagram of a terminal 700 according to an exemplary embodiment of the present disclosure. The terminal 700 may be a smart phone, a tablet computer, a Moving Picture Experts Group Audio Layer III (MP3) player, a Moving Picture Experts Group Audio Layer IV (MP4) player, or a laptop or desktop computer. The terminal 700 may also be referred to as a user equipment, a portable terminal, a laptop terminal, a desktop terminal, or the like.

Generally, the terminal 700 includes a processor 701 and a memory 702.

The processor 701 may include one or more processing cores, such as a 4-core processor, an 8-core processor, or the like. The processor 701 may be practiced by using at least one of hardware forms in a digital signal processor (DSP), a field-programmable gate array (FPGA) and a programmable logic array (PLA). The processor 701 may also include a main processor and a co-processor. The main processor is a processor for processing data in an awaken state, and is also called as a central processing unit (CPU). The co-processor is a low-power processor for processing data in a standby state. In some embodiments, the processor 701 may be integrated with a graphics processing unit (GPU) which is responsible for rendering and drawing of content required to be displayed by a display. In some embodiments, the processor 701 may also include an artificial intelligence (AI) processor for processing a calculation operation related to machine learning.

The memory 702 may include one or more computer-readable storage media which may be non-transitory. The memory 702 may also include a high-speed random-access memory, as well as a non-volatile memory, such as one or more disk storage devices and flash storage devices. In some embodiments, the non-transitory computer-readable storage medium in the memory 702 is configured to store at least one instruction which is executable by the processor 701 to implement the method for determining the karaoke singing score according to the embodiments of the present disclosure.

In some embodiments, the terminal 700 may optionally include a peripheral device interface 703 and at least one peripheral device. The processor 701, the memory 702 and the peripheral device interface 703 may be connected to each other via a bus or a signal line. The at least one peripheral device may be connected to the peripheral device interface 703 via a bus, a signal line or a circuit board. Specifically, the peripheral device includes at least one of a radio frequency circuit 704, a touch display screen 705, a camera assembly 706, an audio circuit 707, a positioning assembly 708 and a power source 709.

The peripheral device interface 703 may be configured to connect the at least one peripheral device related to input/output (I/O) to the processor 701 and the memory 702. In some embodiments, the processor 701, the memory 702 and the peripheral device interface 703 are integrated on the same chip or circuit board. In some other embodiments, any one or two of the processor 701, the memory 702 and the peripheral device interface 703 may be practiced on a separate chip or circuit board, which is not limited in this embodiment.

The radio frequency circuit 704 is configured to receive and transmit a radio frequency (RF) signal, which is also referred to as an electromagnetic signal. The radio frequency circuit 704 communicates with a communication network or another communication device via the electromagnetic signal. The radio frequency circuit 704 converts an electrical signal to an electromagnetic signal and sends the signal, or converts a received electromagnetic signal to an electrical signal. Optionally, the radio frequency circuit 704 includes an antenna system, an RF transceiver, one or a plurality of amplifiers, a tuner, an oscillator, a digital signal processor, a codec chip set, a subscriber identification module card or the like. The radio frequency circuit 704 may communicate with another terminal based on a wireless communication protocol. The wireless communication protocol includes, but not limited to: a metropolitan area network, generations of mobile communication networks (including 2G, 3G, 4G and 5G), a wireless local area network and/or a wireless fidelity (WiFi) network. In some embodiments, the radio frequency circuit 704 may further include a near field communication (NFC)-related circuits, which is not limited in the present disclosure.

The display screen 705 may be configured to display a user interface (UI). The UE may include graphics, texts, icons, videos and any combination thereof. When the display screen 705 is a touch display screen, the display screen 705 may further have the capability of acquiring a touch signal on a surface of the display screen 705 or above the surface of the display screen 705. The touch signal may be input to the processor 701 as a control signal, and further processed therein. In this case, the display screen 705 may be further configured to provide a virtual button and/or a virtual keyboard or keypad, also referred to as a soft button and/or a soft keyboard or keypad. In some embodiments, one display screen 705 may be provided, which is arranged on a front panel of the terminal 700. In some other embodiments, at least two display screens 705 are provided, which are respectively arranged on different surfaces of the terminal 700 or designed in a folded fashion. In still some other embodiments, the display screen 705 may be a flexible display screen, which is arranged on a bent surface or a folded surface of the terminal 700. Even, the display screen 705 may be further arranged to an irregular pattern which is non-rectangular, that is, a specially-shaped screen. The display screen 705 may be fabricated from such materials as a liquid crystal display (LCD), an organic light-emitting diode (OLED) and the like.

The camera assembly 706 is configured to capture an image or a video. Optionally, the camera assembly 706 includes a front camera and a rear camera. Generally, the front camera is arranged on a front panel of the terminal, and the rear camera is arranged on a rear panel of the terminal. In some embodiments, at least two rear cameras are arranged, which are respectively any one of a primary camera, a depth of field (DOF) camera, a wide-angle camera and a long-focus camera, such that the primary camera and the DOF camera are fused to implement the background virtualization function, and the primary camera and the wide-angle camera are fused to implement the panorama photographing and virtual reality (VR) photographing functions or other fused photographing functions. In some embodiments, the camera assembly 706 may further include a flash. The flash may be a single-color temperature flash or a double-color temperature flash. The double-color temperature flash refers to a combination of a warm-light flash and a cold-light flash, which may be used for light compensation under different color temperatures.

The audio circuit 707 may include a microphone and a speaker. The microphone is configured to capture an acoustic wave of a user and an environment, and convert the acoustic wave to an electrical signal and output the electrical signal to the processor 701 for further processing, or output to the radio frequency circuit 704 to implement voice communication. For the purpose of stereo capture or noise reduction, a plurality of such microphones may be provided, which are respectively arranged at different positions of the terminal 700. The microphone may also be a microphone array or an omnidirectional capturing microphone. The speaker is configured to convert an electrical signal from the processor 701 or the radio frequency circuit 704 to an acoustic wave. The speaker may be a traditional thin-film speaker, or may be a piezoelectric ceramic speaker. When the speaker is a piezoelectric ceramic speaker, an electrical signal may be converted to an acoustic wave audible by human beings, or an electrical signal may be converted to an acoustic wave inaudible by human beings for the purpose of ranging or the like. In some embodiments, the audio circuit 707 may further include a headphone plug.

The positioning assembly 708 is configured to determine a current geographical position of the terminal 700 to implement navigation or a local based service (LBS). The positioning assembly 708 may be the global positioning system (GPS) from the United States, the Beidou positioning system from China, the Grenas satellite positioning system from Russia or the Galileo satellite navigation system from the European Union.

The power source 709 is configured to supply power for the components in the terminal 700. The power source 709 may be an alternating current, a direct current, a disposable battery or a rechargeable battery. When the power source 709 includes a rechargeable battery, the rechargeable battery may support wired charging or wireless charging. The rechargeable battery may also support the supercharging technology.

In some embodiments, the terminal 700 may further include one or a plurality of sensors 710. The one or plurality of sensors 710 include, but not limited to: an acceleration sensor 711, a gyroscope sensor 712, a pressure sensor 713, a fingerprint sensor 714, an optical sensor 715 and a proximity sensor 716.

The acceleration sensor 711 may detect accelerations on three coordinate axes in a coordinate system established for the terminal 700. For example, the acceleration sensor 711 may be configured to detect components of a gravity acceleration on the three coordinate axes. The processor 701 may control the touch display screen 705 to display the user interface in a horizontal view or a longitudinal view based on a gravity acceleration signal acquired by the acceleration sensor 711. The acceleration sensor 711 may be further configured to acquire motion data of a game or a user.

The gyroscope sensor 712 may detect a direction and a rotation angle of the terminal 700, and the gyroscope sensor 712 may collaborate with the acceleration sensor 711 to capture a 3D action performed by the user for the terminal 700. Based on the data acquired by the gyroscope sensor 712, the processor 701 may implement the following functions: action sensing (for example, modifying the UE based on an inclination operation of the user), image stabilization during the photographing, game control and inertial navigation.

The force sensor 713 may be arranged on a side frame of the terminal and/or on a lowermost layer of the touch display screen 705. When the force sensor 713 is arranged on the side frame of the terminal 700, a grip signal of the user against the terminal 700 may be detected, and the processor 701 implements left or right hand identification or perform a shortcut operation based on the grip signal acquired by the force sensor 713. When the force sensor 713 is arranged on the lowermost layer of the touch display screen 705, the processor 701 implement control of an operable control on the UI based on a force operation of the user against the touch display screen 705. The operable control includes at least one of a button control, a scroll bar control, an icon control, and a menu control.

The fingerprint sensor 714 is configured to acquire fingerprints of the user, and the processor 701 determines the identity of the user based on the fingerprints acquired by the fingerprint sensor 714, or the fingerprint sensor 714 determines the identity of the user based on the acquired fingerprints. When it is determined that the identify of the user is trustable, the processor 701 authorizes the user to perform related sensitive operations, wherein the sensitive operations include unlocking the screen, checking encrypted information, downloading software, paying and modifying settings and the like. The fingerprint sensor 714 may be arranged on a front face a back face or a side face of the terminal 700. When the terminal 700 is provided with a physical key or a manufacturer's logo, the fingerprint sensor 714 may be integrated with the physical key or the manufacturer's logo.

The optical sensor 715 is configured to acquire the intensity of ambient light. In one embodiment, the processor 701 may control a display luminance of the touch display screen 705 based on the intensity of ambient light acquired by the optical sensor 715. Specifically, when the intensity of ambient light is high, the display luminance of the touch display screen 705 is up-shifted; and when the intensity of ambient light is low, the display luminance of the touch display screen 705 is down-shifted. In another embodiment, the processor 701 may further dynamically adjust photographing parameters of the camera assembly 706 based on the intensity of ambient light acquired by the optical sensor.

The proximity sensor 716, also referred to as a distance sensor, is generally arranged on the front panel of the terminal 700. The proximity sensor 716 is configured to acquire a distance between the user and the front face of the terminal 700. In one embodiment, when the proximity sensor 716 detects that the distance between the user and the front face of the terminal 700 gradually decreases, the processor 701 controls the touch display screen 705 to switch from an active state to a rest state; and when the proximity sensor 716 detects that the distance between the user and the front face of the terminal 700 gradually increases, the processor 701 controls the touch display screen 705 to switch from the rest state to the active state.

A person skilled in the art may understand that the structure of the terminal as illustrated in FIG. 7 does not construe a limitation on the terminal 700. The terminal may include more components over those illustrated in FIG. 7, or combinations of some components, or employ different component deployments.

Other embodiments of the present disclosure will be apparent to those skilled in the art from consideration of the specification and practice of the present disclosure. This application is intended to cover any variations, uses, or adaptations of the present disclosure following the general principles thereof and including common knowledge or commonly used technical measures which are not disclosed herein. The specification and embodiments are to be considered as exemplary only, with a true scope and spirit of the present disclosure is indicated by the following claims.

It may be appreciated that the present disclosure is not limited to the exact constructions that have been described above and illustrated in the accompanying drawings, and various modifications and changes may be made without departing from the scope of the present disclosure. The scope of the present disclosure is only defined by the appended claims.

What is claimed is:

1. A method for determining a karaoke singing score, comprising:

acquiring a singing audio by an audio capture device, upon detection of a karaoke singing instruction about a target song;

for each of at least one time units, determining pitch values corresponding to the time unit and each of at least one time offset units respectively in the singing audio, scoring each of the pitch values corresponding to the time unit and each time offset unit based on a reference pitch value of the time unit, to obtain a score corresponding to the time unit; wherein the time unit is obtained by dividing a voice period of the target song, and the time offset unit is obtained by performing time offset adjustment on a corresponding time unit based on an adjustment duration, and wherein the time unit and each time offset unit respectively contain a plurality of unit durations; and determining a total score of the singing audio based on a score corresponding to each time unit, wherein the determining and scoring comprises:

in the singing audio, determining a pitch value corresponding to each unit duration contained in the time unit and a pitch value corresponding to each unit duration contained in each time offset unit;

determining a unit duration score corresponding to each unit duration contained in the time unit according to the pitch value corresponding to each unit duration contained in the time unit and the reference pitch value of the time unit;

determining a unit duration score corresponding to each unit duration contained in each time offset unit according to the pitch value corresponding to each unit duration contained in each time offset unit and the reference pitch value of the time unit;

determining a reference score corresponding to the time unit based on the unit duration score corresponding to each unit duration contained in the time unit;

determining a reference score corresponding to each time offset unit based on the unit duration score corresponding to each unit duration contained in each time offset unit; and determining a score corresponding to the time unit based on the reference scwherore corresponding to the time unit and the reference score corresponding to each time offset unit.

2. The method of claim 1, wherein determining a unit duration score corresponding to each unit duration contained in the time unit according to the pitch value corresponding to each unit duration contained in the time unit and the reference pitch value of the time unit comprises:

determining a difference between the pitch value corresponding to each unit duration contained in the time unit and the reference pitch value of the time unit to obtain a difference corresponding to each unit duration contained in the time unit, and determining, based on a corresponding relationship between difference ranges and unit duration scores, the unit duration score corresponding to each unit duration contained in the time unit respectively according to a difference range to which the difference corresponding to each unit duration contained in the time unit belongs; and determining a unit duration score corresponding to each unit duration contained in each time offset unit according to the pitch value corresponding to each unit duration contained in each offset time unit time offset unit and the reference pitch value of the time unit comprises:

determining a difference between the pitch value corresponding to each unit duration contained in each time offset unit and the reference pitch value of the time unit to obtain a difference corresponding to each unit duration contained in each time offset unit, and determining, based on a corresponding relationship between difference ranges and unit duration scores, the unit duration score corresponding to each unit duration contained in each time offset unit respectively according to a difference range to which the difference corresponding to each unit duration contained in each offset time unit time offset unit belongs.

3. The method of claim 1, wherein upon scoring each of the pitch values corresponding to the time unit and each time offset unit based on a reference pitch value of the time unit, to obtain a score corresponding to the time unit, the method further comprises:

determining an adjustment duration of each time offset unit with the highest score relative to the corresponding time unit as an adjustment duration corresponding to each time unit;

determining a value obtained by dividing a sum of the adjustment durations corresponding to each of time units by the number of the time units as an average of the adjustment durations; and determining a total score of the singing audio based on a score corresponding to each time unit comprises:

determining the total score of the singing audio based on the score corresponding to each time unit if an absolute value of a difference between the adjustment duration corresponding to each time unit and the average of the adjustment durations is less than a difference threshold.

4. The method of claim 1, wherein determining a reference score corresponding to the time unit according to the unit duration score corresponding to each unit duration contained in the time unit comprises:

determining, based on a weight corresponding to each unit duration score, a weighted average of unit duration scores corresponding to each of unit durations contained in the time unit as the reference score corresponding to the time unit; and determining a reference score corresponding to each time offset unit according to the unit duration score corresponding to each unit duration contained in each time offset unit comprises:

determining, based on a weight corresponding to each unit duration score, a weighted average of unit duration scores corresponding to each of unit durations contained in each time offset unit as the reference score corresponding to the time unit.

5. The method of claim 1, wherein scoring each of the pitch values corresponding to the time unit and each time offset unit based on a reference pitch value of the time unit, to obtain a score corresponding to the time unit comprises:

scoring each of the pitch values corresponding to the time unit and each time offset unit based on the reference pitch value of the time unit, and determining a highest score as the score corresponding to the time unit.

6. The method of claim 1, wherein each time unit corresponds to one note in the voice period; and a start moment of the time unit is a start moment of the corresponding note, and an end moment of the time unit is an end moment of the corresponding note.

7. The method of claim 1, wherein each time unit corresponds to a plurality of time offset units, and the adjustment duration of each time offset unit relative to a corresponding time unit is a positive integer multiple of a unit adjustment time.

8. A terminal, comprising: a processor and a memory, wherein the memory stores at least one instruction, at least one program, a code set or an instruction set; wherein the at least one instruction, the at least one program, the code set or the instruction set is loaded and executed by the processor to implement a method, and the method comprises:

acquiring a singing audio by an audio capture device, upon detection of a karaoke singing instruction about a target song;

for each of at least one time units, determining pitch values corresponding to the time unit and each of at least one time offset units respectively in the singing audio, scoring each of the pitch values corresponding to the time unit and each time offset unit based on a reference pitch value of the time unit, to obtain a score corresponding to the time unit; wherein the time unit is obtained by dividing a voice period of the target song, and the time offset unit is obtained by performing time offset adjustment on a corresponding time unit based on an adjustment duration, wherein the time unit and each time offset unit respectively contain a plurality of unit durations; and determining a total score of the singing audio based on a score corresponding to each time unit, wherein the determining and scoring comprises:

in the singing audio, determining a pitch value corresponding to each unit duration contained in the time unit and a pitch value corresponding to each unit duration contained in each time offset unit;

determining a unit duration score corresponding to each unit duration contained in the time unit according to the pitch value corresponding to each unit duration contained in the time unit and the reference pitch value of the time unit;

determining a unit duration score corresponding to each unit duration contained in each time offset unit according to the pitch value corresponding to each unit duration contained in each time offset unit and the reference pitch value of the time unit;

determining a reference score corresponding to the time unit based on the unit duration score corresponding to each unit duration contained in the time unit;

determining a reference score corresponding to each time offset unit based on the unit duration score corresponding to each unit duration contained in each time offset unit; and determining a score corresponding to the time unit based on the reference score corresponding to the time unit and the reference score corresponding to each time offset unit.

9. The terminal of claim 8, wherein determining a unit duration score corresponding to each unit duration contained in the time unit according to the pitch value corresponding to each unit duration contained in the time unit and the reference pitch value of the time unit comprises:

determining a difference between the pitch value corresponding to each unit duration contained in the time unit and the reference pitch value of the time unit to obtain a difference corresponding to each unit duration contained in the time unit, and determining, based on a corresponding relationship between difference ranges and unit duration scores, the unit duration score corresponding to each unit duration contained in the time unit respectively according to a difference range to which the difference corresponding to each unit duration contained in the time unit belongs; and determining a unit duration score corresponding to each unit duration contained in each time offset unit according to the pitch value corresponding to each unit duration contained in each time offset unit and the reference pitch value of the time unit comprises:

determining a difference between the pitch value corresponding to each unit duration contained in each time offset unit and the reference pitch value of the time unit to obtain a difference corresponding to each unit duration contained in each time offset unit, and determining, based on a corresponding relationship between difference ranges and unit duration scores, the unit duration score corresponding to each unit duration contained in each time offset unit respectively according to a difference range to which the difference corresponding to each unit duration contained in each time offset unit belongs.

10. The terminal of claim 8, wherein determining a reference score corresponding to the time unit according to the unit duration score corresponding to each unit duration contained in the time unit comprises:

determining, based on a weight corresponding to each unit duration score, a weighted average of unit duration scores corresponding to each of unit durations contained in the time unit as the reference score corresponding to the time unit; and determining a reference score corresponding to each time offset unit according to the unit duration score corresponding to each unit duration contained in each time offset unit comprises:

determining, based on a weight corresponding to each unit duration score, a weighted average of unit duration scores corresponding to each of unit durations contained in each time offset unit as the reference score corresponding to the time unit.

11. The terminal of claim 8, wherein scoring each of the pitch values corresponding to the time unit and each time offset unit based on a reference pitch value of the time unit, to obtain a score corresponding to the time unit comprises:

scoring each of the pitch values corresponding to the time unit and each time offset unit based on the reference pitch value of the time unit, and determining a highest score as the score corresponding to the time unit.

12. The terminal of claim 8, wherein upon scoring each of the pitch values corresponding to the time unit and each time offset unit based on a reference pitch value of the time unit, to obtain a score corresponding to the time unit, the method further comprises:

determining an adjustment duration of each time offset unit with the highest score relative to the corresponding time unit as an adjustment duration corresponding to each time unit;

determining a value obtained by dividing a sum of the adjustment durations corresponding to each of time units by the number of the time units as an average of the adjustment durations; and determining a total score of the singing audio based on a score corresponding to each time unit comprises:

determining the total score of the singing audio based on the score corresponding to each time unit if an absolute value of a difference between the adjustment duration corresponding to each time unit and the average of the adjustment durations is less than a difference threshold.

13. The terminal of claim 8, wherein each time unit corresponds to one note in the voice period; and a start moment of the time unit is a start moment of the corresponding note, and an end moment of the time unit is an end moment of the corresponding note.

14. The terminal of claim 8, wherein each time unit corresponds to a plurality of time offset units, and the adjustment duration of each time offset unit relative to a corresponding time unit is a positive integer multiple of a unit adjustment time.

15. A computer-readable storage medium, wherein the storage medium stores at least one instruction, at least one program, a code set, or an instruction set; wherein the at least one instruction, the at least one program, the code set or the instruction set is loaded and executed by a processor to implement a method, and the method comprises:

acquiring a singing audio by an audio capture device, upon detection of a karaoke singing instruction about a target song;

for each of at least one time units, determining pitch values corresponding to the time unit and each of at least one time offset units respectively in the singing audio, scoring each of the pitch values corresponding to the time unit and each time offset unit based on a reference pitch value of the time unit, to obtain a score corresponding to the time unit; wherein the time unit is obtained by dividing a voice period of the target song, and the time offset unit is obtained by performing time offset adjustment on a corresponding time unit based on an adjustment duration, wherein the time unit and each time offset unit respectively contain a plurality of unit durations; and determining a total score of the singing audio based on a score corresponding to each time unit, wherein the determining and scoring comprises:

in the singing audio, determining a pitch value corresponding to each unit duration contained in the time unit and a pitch value corresponding to each unit duration contained in each time offset unit;

determining a unit duration score corresponding to each unit duration contained in the time unit according to the pitch value corresponding to each unit duration contained in the time unit and the preset reference pitch value of the time unit;

determining a unit duration score corresponding to each unit duration contained in each time offset unit according to the pitch value corresponding to each unit duration contained in each time offset unit and the reference pitch value of the time unit;

determining a reference score corresponding to the time unit based on the unit duration score corresponding to each unit duration contained in the time unit;

determining a reference score corresponding to each time offset unit based on the unit duration score corresponding to each unit duration contained in each time offset unit; and determining a score corresponding to the time unit based on the reference score corresponding to the time unit and the reference score corresponding to each time offset unit.

16. The computer-readable storage medium of claim 15, wherein determining a unit duration score corresponding to each unit duration contained in the time unit according to the pitch value corresponding to each unit duration contained in the time unit and the reference pitch value of the time unit comprises:

determining a difference between the pitch value corresponding to each unit duration contained in the time unit and the reference pitch value of the time unit to obtain a difference corresponding to each unit duration contained in the time unit, and determining, based on a corresponding relationship between difference ranges and unit duration scores, the unit duration score corresponding to each unit duration contained in the time unit respectively according to a difference range to which the difference corresponding to each unit duration contained in the time unit belongs; and determining a unit duration score corresponding to each unit duration contained in each time offset unit according to the pitch value corresponding to each unit duration contained in each time offset unit and the reference pitch value of the time unit comprises:

determining a difference between the pitch value corresponding to each unit duration contained in each time offset unit and the reference pitch value of the time unit to obtain a difference corresponding to each unit duration contained in each time offset unit, and determining, based on a corresponding relationship between difference ranges and unit duration scores, the unit duration score corresponding to each unit duration contained in each time offset unit respectively according to a difference range to which the difference corresponding to each unit duration contained in each time offset unit belongs.

17. The computer-readable storage medium of claim 15, wherein determining a reference score corresponding to the time unit according to the unit duration score corresponding to each unit duration contained in the time unit comprises:

determining, based on a weight corresponding to each unit duration score, a weighted average of unit duration scores corresponding to each of unit durations contained in the time unit as the reference score corresponding to the time unit; and determining a reference score corresponding to each time offset unit according to the unit duration score corresponding to each unit duration contained in each time offset unit comprises:

determining, based on a weight corresponding to each unit duration score, a weighted average of unit duration scores corresponding to each of unit durations contained in each time offset unit as the reference score corresponding to the time unit.

* * * * *